United States Patent [19]

Mrazek et al.

[11] 4,000,057

[45] Dec. 28, 1976

[54] ELECTROLYTIC CELL MEMBRANE CONDITIONING

[75] Inventors: Kenneth S. Mrazek; Brian Crumblehulme, both of North Vancouver, Canada

[73] Assignee: Hooker Chemicals & Plastics Corporation, Niagara Falls, N.Y.

[22] Filed: Nov. 21, 1974

[21] Appl. No.: 525,803

[52] U.S. Cl. ..... 204/296; 429/188

[51] Int. Cl.[2] ..... C25B 13/03

[58] Field of Search ..... 204/296; 136/154, 142, 136/143; 260/29.6 F

[56] References Cited

UNITED STATES PATENTS

| | | | |
|---|---|---|---|
| 2,200,301 | 5/1940 | Ruben | 136/154 UX |
| 3,684,747 | 8/1972 | Coalson et al. | 260/2.5 R |
| 3,884,777 | 5/1975 | Harke et al. | 204/84 |

*Primary Examiner*—F.C. Edmundson
*Attorney, Agent, or Firm*—Peter F. Casella; Herbert W. Mylius

[57] ABSTRACT

A permselective membrane, suitable for use in electrolytic cells, is conditioned for such use by expanding it to a desirable extent by immersing it in or coating it with a liquid solvent system in which the membrane exhibits a substantially flat expansion vs. time curve for at least the first four hours after the completion of such immersion or coating, after which the membrane is mounted so as to be ready for use. When inserted into an electrolytic cell, in contact with the electrolyte thereof, the membrane will then be of such a size as to produce the desired amount of tension thereon, making the membrane flat and non-sagging, without over-contraction which could lead to tearing.

10 Claims, 2 Drawing Figures

ELECTROLYTIC CELL MEMBRANE CONDITIONING

Figure 1:
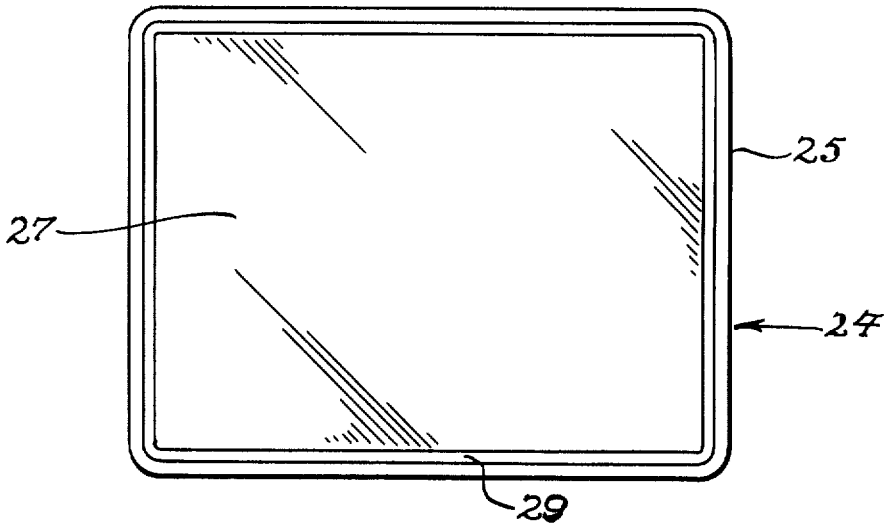

This invention relates to the conditioning of membranes for use in electrolytic cells. More particularly, this invention relates to controllably expanding a permselective membrane of the cation-active type prior to installation of the membrane on a frame for use in an electrolytic cell.

Membrane cells, utilizing permselective membranes, have recently been employed and have been found to be superior to conventional diaphragm cells. The membranes of such cells are desirably held in place between the anode and cathode and divide the cell into anolyte and catholyte compartments, allowing the flow of current between such compartments but usefully preventing or inhibiting the transport of certain ions and products of electrolysis. Some membranes employed expand or contract in the electrolyte and therefore may cause the production of sags in the membrane or may tighten the membrane so much as to put the membrane in danger of being ruptured. Also, during assembly of a multi-cell electrolytic apparatus a membrane which has been previously wetted, as with water, may dry out, which could cause such a severe contraction as to tear the membrane before installation or make the membrane susceptible to such tearing.

In the past membranes have been immersed or soaked in water or brine before mounting and installation but to avoid irregular contractions of a plurality of membranes being installed in a series of cells or cell assembly it is necessary that such assembling be carried out within a very short period of time. Otherwise, irregular contractions result, the degree of tautness of the various membranes can be different, and some membranes might be tightened too much.

By the method of this invention controllable contractions of the membranes are obtained so that they are desirably tight when mounted for use in an electrolytic cell and are not objectionably taut before such mounting. In accordance with the present invention a method of conditioning a permselective membrane for a subsequent use in an electrolytic cell comprises expanding the membrane to a desirable extent by immersing the membrane in or coating the membrane with a liquid solvent in which the membrane exhibits a substantially flat expansion vs. time curve for at least the first four hours after immersion or coating, (such liquid solvent hereinafter referred to as "an expansion solution"), mounting the membrane in an elecrolytic cell, an electrolytic cell frame or other cell mounting part and contacting the membrane in the electrolytic cell with an electrolyte which has such contraction vs. time characteristics as to produce a desired amount of tension on the membrane so as to make the membrane flat and non-sagging. Preferably, the method relates to the treatment of a cation-active permselective membrane, which is a hydrolyzed copolymer of a perfluorinated hydrocarbon and a fluorosulfonated perfluorovinyl ether, with an expansion solution system comprising a polyol such as glycerol, water and salt, preferably at an acidic pH, e.g., 2 to 4, and subsequent mounting in a frame for installation in an electrolytic cell used for the electrolysis of brine.

Figure 2:
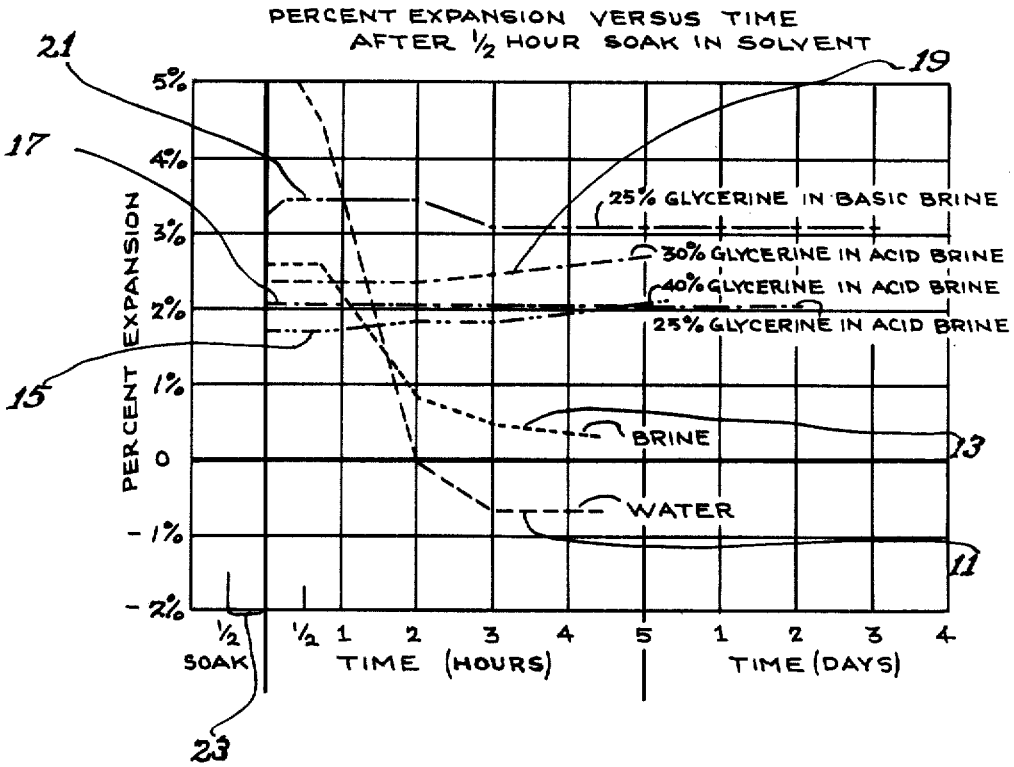

The invention will be readily understood from reference to the description herein, taken in conjunction with the drawing in which:

FIG. 1 is a front elevational view of a frame holding in place, for installation in a membrane cell for the electrolysis of brine, a preferred cation-active permselective membrane which is a hydrolyzed copolymer of tetrafluoroethylene and $FSO_2CF_2CF_2OCF(CF_3)CF_2OCF{=}CF_2$; and FIG. 2 is a graphical representation of expansion vs. time after completion of soakings of such a permselective membrane in different expansion solutions.

A frame 24 is illustrated in FIG. 1 in which there is shown a portion of an electrolytic cell body 25, in this case made of molded polypropylene, containing a groove in an interior face thereof into which membrane 27 is tightly held by fastening means 29, which presses the membrane into the groove. Such installation is made shortly after removal of the membrane from a solution in which the membrane was soaking, and the fastening means or frame holds the membrane in such a position that the membrane will have the desired tension thereon when the membrane is employed in the electrolytic cell. Means 29 may be any suitable means for holding the membrane in position between the anode and cathode of the cell or between either electrode and a buffer compartment therein, including machine screws or plugs, adhesives and frictional holders molded into the cell body part or frame.

In FIG. 2, a plot of percent expansion of the membrane vs. time, there are shown expansion vs. time curves for water 11, brine 13, glycerol (40%) in acid brine 15, glycerol (25%) in acid brine 17, glycerol (30%) in acid brine 19, and glycerol (25%) in basic brine 21. As indicated at 23, there is a one-half hour soaking period for specimens of the membrane being treated separately with each of the mentioned liquids, which are herein referred to as expansion solutions. Thereafter, the membrane is removed from the bath, wiped or hung to remove excess solution from the membrane and then is utilized in an electrolytic cell. Preferably, as soon as the membrane is soaked for the desired time, which usually will be from five minutes to five hours, preferably for ten minutes to one hour, the membrane will be mounted on a frame or mounting portion of an electrolytic cell and will be put in use soon after assembly of such cell.

For the purposes of testing expansions and contractions of the membranes in various expansion solutions the dimensions of the membrane are measured after the membrane is suspended for the times mentioned, hanging in air but not tightly mounted in position on the cell frame. However, the results are similar in both cases.

Because electrolytic cell assemblies, such as those for the electrolysis of brine, may include a multiplicity of membrane cell units, each of which contains at least one membrane, it takes time to assemble all the cells together, in which time, unless the membranes are maintained in a substantially dimensionally stable state, there is a danger that the membranes might contract so much as to tear or pull loose from the mounting means employed. Normally, it takes at least three hours and usually at least four hours to assemble a multi-cell electrolytic apparatus having from 10 to 100 cells, usually from 20 to 60 cells and most frequently from 25 to 50 cells and therefore it is important that during such period, in which the mounted membrane might be exposed to ambient air and out of expansion solution, the membrane should not unduly change dimensions, which could very adversely affect the membrane, either by expanding the membrane excessively, which could cause the development of wrinkles or warps in the membrane or by contracting the membrane, which might strain the membrane and in some cases cause the membrane to tear or be released from the mounting means. Therefore, it is important that after undergoing the soak treatment of this invention the membrane should exhibit a substantially flat expansion vs. time curve for at least the first four hours thereafter, during which time the membrane may be hanging in ambient air, as in the test herein described, or preferably, is mounted on a frame installed or to be installed in an electrolytic cell apparatus.

The substantially flat expansion vs. time curve referred to is such that in the first four hours, preferably for 24 hours and even for as long as a week, the variations in the dimensions of the membrane for either height or width will be within 2%, preferably within 1% and most preferably within one-half percent of its dimension immediately after completion of the soaking operation. Also, the dimensions after soaking will be within 2%, preferably within 1% and most preferably within one-half percent of the equilibrium dimension of the same membrane in a brine such as is employed in an electrolytic cell. Because in two compartment electrolytic cells for the electrolysis of brine on one side of the membrane there is usually present acidic brine, at a pH of about 3 to 4, and on the other side there is sodium hydroxide solution, usually at a pH of 13 to 14, it might be expected that there would be a differential expansion (or contraction) of the membrane during use. In practice, with respect to electrolysis of brine, objectionable differential expansions are not noticed and it is practicable to treat the membrane, even laminated membranes of different characteristics on the different sides thereof, such as those of slightly different hydrolyzed copolymers of a perfluorinated hydrocarbon and a fluorosulfonated perfluorovinyl ether, with acid, basic or neutral brines containing glycerol, or other suitable "flat curve" solvents to pre-condition them before use. However, where desired, the membranes may be treated differently on either side thereof. This may be effected most conveniently by coating the surfaces with different "soaking media" as by roll application, spraying or other suitable means. Such conditioning will expand (or contract, although contractions are rare) the different sides of the membrane differently so that in use, they would be shrunk or expanded in corresponding manner by the different cell media. Thus, for example, if side A of a membrane would normally contact an electrolyte which would expand it 1% and side B would normally contact an electrolyte that would expand it 2%, it might well be desirable to coat side A with an expansion solution that would normally expand the membrane 2% and side B with an expansion solution that would expand it 3% (both of which would have substantially flat expansion-time curves). Such expansion solutions can be formulated from various mixtures of organic and inorganic materials in water, preferably wherein the organic material has swelling properties on the membrane similar to those of the solutions described in FIG. 2.

In addition to the membrane protective aspects of this invention to prevent excessive contraction of the membrane before installation in a cell and flooding of the cell with electrolyte, the invention may also be employed to treat membranes removed from an electrolytic cell after some use, usually to prevent them from "drying out" and contracting so much as to destroy them. Generally, if the extent of contraction is more than 2%, there is danger of harm to the membrane and preferably such contraction is limited to 1% and most preferably 0.5%.

In the practice of the present invention it is initially determined to what extent the membrane utilized will expand (or contract) when soaked in the intended electrolyte to be employed in the electrolytic cell. In the case of brine, whether acidic or basic (acidic brines referred to are of pH's in the range of 2 to 5, preferably 3 to 4 and basic brines are at pH's of 9 to 12, preferably 10 to 11), or neutral, a cation-active permselective membrane which is a hydrolyzed copolymer of a perfluorinated hydrocarbon and fluorosulfonated perfluorovinyl ether, whether of a single material or a laminate and whether thin, e.g., 0.1 mm. of thick, e.g., 0.5 mm., exhibits about the same expansions, within the range of 1 to 4%, e.g., 2 to 3%, immediately after completion of soakings. However, other ranges of expansion (or contraction) can be employed for other membrane materials and of course, other electrolytes can be utilized. After determination of the normal expansion of the membrane in the membrane's intended electrolyte a selection is made of the treatment solvent system, based on the differential in expansions (or contractions) desired. Of course, the expansion solution will be one having a substantially flat and preferably almost exactly flat expansion vs. time curve over a period of at least four hours and preferably for up to seven days.

In the curves of FIG. 2 it will be noted that the 25% glycerol in basic brine (25% glycerol, 25% NaCl, 50% water, at a pH of 10.5) initially expands the membrane about 0.7% more than does the brine. This means that if, after hydrolysis of the membrane thermoplastic material to produce the desired hydrolyzed copolymer (such hydrolysis often being effected by boiling in water), the membrane is soaked in the 25% glycerol and basic brine there would be about a 0.7% contraction (it may range from 0.5 to 0.8%, as may be seen from the curve) of the mounted membrane after the membrane is installed in the electrolytic cell and is contacted by the electrolyte. This is so because the electrolyte washes out the glycerol and other material and replaces it with such electrolyte, causing the ultimate expansion of the membrane to be that which the membrane would undergo in the electrolyte. Since there was a 0.7% contraction, the membrane would be tightened in the frame or other holding device in the electrolytic cell but would not be overly tightened to the point where the membrane might be unduly strained, split, easily torn or otherwise damaged.

If the membrane is initially treated with an acidic brine of the types illustrated in curves 15, 17 and 19, in FIG. 2, it will be noted that the expansions obtained are not as great as that of brine alone (25% NaCl in water). Using, as an example, the 25% glycerol, 25% NaCl, 50% water expansion solution, the properties of which are depicted on curve 17, it is seen that about 2% expansion results and that after removal of the membrane from the expansion solution this does not change even after two days. Actually, the change is slight over a period as long as seven days. When a membrane that has been soaked in the 25% glycerol and brine is fastened to a mounting frame for an electrolytic cell and is then allowed to stand in air for up to two days, there is no undesirable expansion or contraction and after installation in the electrolytic cell the expansion is about 0.5%. This can be compensated for by pulling the membrane sufficiently tight, without tearing the membrane, when the membrane is installed on the frame shortly after removal from the soaking solution. Thus, the final mounted membrane will be of the desired tautness and such desired condition can be planned and assured by following the procedures of this invention.

After completion of use of a mounted membrane and removal of it from a cell, if the membrane is still serviceable and ready for reuse in the same or different cell the membrane may be prevented from tightening excessively while awaiting reinstallation by being treated with one of the mentioned expansion solutions or an equivalent which has the same type of effect. Thus, if such a membrane were to be treated with a 30% glycerine and acid brine solvent system the membrane would initially contract about 0.2% and subsequently, over a period of four hours, be about 0.1% more relaxed than when the membrane was removed from the electrolytic cell. Such minor variations would not adversely affect the membrane during storage prior to reuse. Similar effects would be obtained using the other mentioned expansion solutions and the like and equivalents. If the membrane were not to be treated as mentioned the membrane could, over a comparatively short period (four hours), contract over 2% (see curve 13 of FIG. 2), which could be damaging.

The present method is useful in the treatment of various membrane materials for use in electrolytic cells. Normally, the membranes will be organic polymers which are compatible with the various expansion solutions. The membranes may be selected from those which have been described in the numerous patents that have issued on membranes suitable for electrolytic processes, some of which are U.S. Pat. Nos. 2,681,320; 2,731,411; 2,827,426; 2,891,015; 2,894,289; 2,921,005; 3,017,338; and 3,438,879, the disclosures of which are incorporated herein by reference. Also useful are sulfostyrenated perfluoroethylene propylene polymer membranes, which may be made by styrenating a standard FEP, such as is manufactured by E. I. DuPont De Nemours & Company, Inc., and then sulfonating the membrane. Such products are manufactured by RAI Research Corporation, Hauppauge, New York and are identified as 18ST12S and 16ST13S, the former being 18% styrenated and having two-thirds of the phenol groups monosulfonated and the latter being 16% styrenated and having a 13/16 of the phenol groups monosulfonated.

Although the present method is applicable to a wide variety of polymeric membranes and may even be applied to inorganic membranes, it is most usefully employed with respect to those cation-active permselective membranes which are hydrolyzed copolymers of a perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 to 5 carbon atoms may also be utilized, of which the monoolefinic hydrocarbons are preferred, especially those of 2 to 4 carbon atoms and most especially those of 2 to 3 carbon atoms, e.g., tetrafluoroethylene and hexafluoropropylene. The sulfonated perfluorovinyl ether which is most useful is that of the formula $FSO_2CF_2CF_2OCF(CF_3)CF_2OCF{=}CF_2$. Such a material, names as perfluoro[2-(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluorolower alkyl groups, respectively. However, it is most preferred to employ PSEPVE.

The method of manufacture of the hydrolyzed copolymer is described in Example XVII of U.S. Pat. No. 3,282,875 and an alternative method is mentioned in Canadian pat. No. 849,670, which also discloses the use of the finished membrane in fuel cells, characterized therein as electrochemical cells. The disclosures of such patents are hereby incorporated herein by reference. In short, the copolymer may be made by reacting PSEPVE or equivalent with tetrafluoroethylene or equivalent in desired proportions in water at elevated temperature and pressure for over an hour, after which time the mix is cooled. It separates into a lower perfluoroether layer and an upper layer of aqueous medium with dispersed desired polymer. The molecular weight is indeterminate but the equivalent weight is about 900 to 1,600 preferably 1,100 to 1,400 and the percentage of PSEPVE or corresponding compound is about 10 to 30%, preferably 15 to 20% and most preferably about 17%. The unhydrolyzed copolymer may be compression molded at high temperature and pressure to produce sheets or membranes, which may vary in thickness from 0.02 to 0.5 mm. These are then further treated to hydrolyze pendant $-SO_2F$ groups to $-SO_3H$ groups, as by treating with 10% sulfuric acid or by the methods of the patents previously mentioned. The presence of the $-SO_3H$ groups may be verified by titration, as described in Canadian Pat. No. 849,670. Additional details of various processing steps are described in Canadian Pat. No. 752,427 and U.S. Pat. No. 3,041,317, also hereby incorporated by reference.

Because it has been found that some expansion accompanies hydrolysis of the copolymer it is often preferred to position the copolymer membrane after hydrolysis onto a frame or other support which will hold it in place in the electrolytic cell. Then it may be clamped or cemented in place and will be true, without sags. The membrane is preferably joined to the backing tetrafluoroethylene or other suitable filaments prior to hydrolysis, when it is still thermoplastic; and the film of copolymer covers each filament, penetrating into the spaces between them and even around behind them, thinning the film slightly in the process, where it covers the filaments.

The membrane described is far superior in the present processes to all other previously suggested membrane materials. It is more stable at elevated temperatures, e.g. above 75° C. It lasts for much longer time periods in the medium of the electrolyte and the caustic product and does not become brittle when subjected to chlorine at high cell temperatures. Considering the savings in time and fabrication costs, the present membranes are more economical. The voltage drop through the membranes is acceptable and does not become inordinately high, as it does with many other membrane materials, when the caustic concentration in the cathode compartment increases to above about 200 g./l. of caustic. The selectivity of the membrane and its compatibility with the electrolyte do not decrease detrimentally as the hydroxyl concentration in the catholyte liquor increases, as has been noted with other membrane materials. Furthermore, the caustic efficiency of the electrolysis does not diminish as significantly as it does with other membranes when the hydroxyl ion concentration in the catholyte increases. While the more preferred copolymers are those having equivalent weights of 900 to 1,600, with 1,100 to 1,500 being most preferred, some useful resinous membranes produced by the present method may be of equivalent weights from 500 to 4,000. The medium equivalent weight polymers are preferred because they are of satisfactory strength and stability, enable better selective ion exchange to take place and are of lower internal resistances, all of which are important to the present electrochemical cells.

Improved versions of the above-described copolymers may be made by chemical treatment of surfaces thereof, as by treatments to modify the $-SO_3H$ group thereon. For example, the sulfonic group may be altered on the membrane to produce a concentration gradient or may be replaced in part with a phosphoric or phosphonic moiety. Such changes may be made in the manufacturing process or after production of the membrane. When effected as a subsequent surface treatment of a membrane the depth of treatment will usually be from 0.001 to 0.01 mm. In some instances it may be desirable to convert the sulfonyl or sulfonic acid group of the membrane on one side (usually the anode side) to a sulfonamide, which is more hydrophilic, which may be effected in the manner described in U.S. Pat. No. 3,784,399, hereby incorporated by reference. Also, the membrane may be in laminated form, which is now most preferred, with the laminae being of a thickness in the range of 0.07 to 0.17 mm. on the anode side and 0.01 to 0.07 mm. on the cathode side, which laminae are respectively, of equivalent weights in the ranges of 1,000 to 1,200 and 1,350 to 1,600. A preferred thickness for the anode side lamina is in the range of 0.07 to 0.12 mm. thick and most preferably this is about 0.1 mm., with the preferred thickness of the lamina on the cathode side being 0.02 to 0.07 mm., most preferably about 0.05 mm. The preferred and most preferred equivalent weights are 1,050 to 1,150 and 1,100, and 1,450 to 1,550 and 1,500, respectively. The higher the equivalent weight of the individual lamina the lesser the thickness preferred to be used, within the ranges given.

The membrane walls will normally be from 0.02 to 0.5 mm. thick, preferably from 0.07 to 0.4 mm. and most preferably 0.1 to 0.2 mm. Ranges of thicknesses for the portions of the laminated membranes previously described have already been given. When mounted on a polytetrafluoroethylene, asbestos, titanium or other suitable network, for support, the network filaments or fibers will usually have a thickness of 0.01 to 0.5 mm., preferably 0.05 to 0.15 mm., corresponding to up to the thickness of the membrane. Often it will be preferable for the fibers to be less than half the film thickness but filament thicknesses greater than that of the film may also be successfully employed, e.g., 1.1 to 5 times the film thickness. The networks, screens or cloths have an area percentage of openings therein from about 8 to 80%, preferably 10 to 70% and most preferably 20 to 70%. Generally the cross sections of the filaments will be circular but other shapes, such as ellipses, squares and rectangles, are also useful. The supporting network is preferably a screen or cloth and although it may be cemented to the membrane it is preferred that it be fused to it by high temperature, high pressure compression before hydrolysis of the copolymer. Then, the membrane-network composite can be clamped or otherwise fastened in place in a holder or support, after soaking or coating thereof.

The materials of construction of the cell body may be conventional, including concrete or stressed concrete lined with mastics, rubber, e.g., neoprene, polyvinyl chloride, FEP (fluorinated ethylene-propylene), polytetrafluoroethylene or other suitable plastic or may be similarly lined containers of other structural material. Substantially self-supporting structures are highly preferred, such as those of rigid polyvinyl chloride, polyvinylidene chloride, polypropylene or phenol formaldehyde resins and it is preferred that these be reinforced with molded-in fibers, cloths or webs of glass filaments, steel, nylon, etc. The most preferred embodiments of the cells, which may be of either monopolar or bipolar construction, are made of an electrolyte-resistant polymeric material such as molded polypropylene, preferably reinforced with asbestos, mica or calcium silicate fibers or platelets.

The anodes employed are of a suitable material having openings therein through which any chlorine produced adjacent the membrane may escape. The active surface materials of the anodes may be noble metals, noble metal alloys, noble metal oxides, noble metal oxides mixed with valve metal oxides, e.g., ruthenium oxide plus titanium dioxide, or mixtures thereof, normally on a substrate which is sufficiently conductive for the electrolytic operation. Preferably, such surfaces are on an electrolyte-resistant valve metal, such as titanium and connect through it to a conductor of a metal such as copper, silver, aluminum, steel or iron, which is normally clad, plated or otherwise protected with a covering of similar electrolyte-resistant material. It is especially desirable that the openwork portion of the electrodes, excluding the conductors, be of titanium activated on a surface away from the membrane (for generation of chlorine on such surface) with a noble metal or noble metal oxide, such as ruthenium oxide, platinum oxide, ruthenium or platinum. Instead of titanium another useful valve metal is tantalum. In all cases, the conductive material of the conductor is preferably copper, clad with titanium.

The cathodes utilized may be of any electrically conductive material which will resist the attack of the various cell contents. The cathodes are preferably made of steel mesh, joined to a copper conductor but other cathode materials and various conductive materials may also be utilized, among which, for the cathode, are iron, graphite, lead dioxide or graphite, lead dioxide on titanium, or noble metals, such as platinum, iridium, ruthenium or rhodium. When using the noble metals they may be deposited as surfaces on conductive substrates, such as those of copper, silver, aluminum, steel or iron. The cathodes will preferably be of screen or expanded metal mesh and, like the anodes, will be flat or of other conforming shapes so that the inter-electrode distances will be approximately the same throughout.

Conductor rods for transmitting electricity to the anode will preferably be of titanium clad copper and those for conducting electricity from the cathode, preferably to the anode of an adjacent cell, in bipolar arrangement, will be of copper.

The means for fastening the membrane in position on the cell, between anode and cathode, will preferably be nylon or polypropylene screws, which may hold a flange or sealing strip of similar material tightly against the membrane in a channel in the cell body or frame.

The cell operating conditions are those normally employed for the particular electrolytic process practiced, whether it be the electrolysis of brine, hydrochloric acid, hydrofluoric acid, peracids, adiponitrile or any of a wide variety of other electrolyzable substances. However, it is expected that it will usually be employed for the electrolysis of brine to produce sodium hydroxide, chlorine and hydrogen. In the electrolysis of brine the reaction conditions will usually be in the range of 2.3 to 6 volts, preferably 3.5 to 4.5 volts; 0.1 to 0.5 ampere/sq. cm., preferably about 0.3 ampere/sq. cm., and 65 to 105° C., preferably 85° to 95° C. The brine charged will usually be of an acidic pH, of 2 to 5, preferably 3 to 4 and will be of a sodium chloride concentration of about 20 to 25%, preferably about 25%, as charged to the anolyte. The depleted brine withdrawn will contain about 21% sodium chloride. The caustic soda solution made will be of 8 to 45%, preferably 10 to 25% sodium hydroxide.

Any suitable expansion solution that meets the conditions recited herein may be employed providing that the membrane utilized is not adversely affected by the expansion solution. The important thing is that the membrane in the expansion solution should exhibit a substantially flat expansion or contraction curve for a period of at least three to four hours. Among the various materials that may be employed as expansion solution components are water; brine; ethylene glycol; glycerine; sodium hydroxide; synthetic organic detergents; lower alkanols; higher fatty alcohols; organic and mineral acids, such as gluconic acid, sulfuric acid; sequestrants, e.g., trisodium nitrilotriacetate; organic solvent materials, such as tetrahydrofuran, diethyl carbitol, acetone; soaps; and other organic and inorganic salts. Various adjuvants may be present in such compositions and, while normally liquid components are generally preferred (except for inorganic salt components), soluble solids may also be used.

The proportion of water in the expansion solution will usually be substantial, rarely being less than 30% and often being in the 50 to 90% range. It is preferred to employ an organic expansion solution material and an inorganic salt material, in addition to the water. Thus, among the most preferred expansion solutions are those comprising a polyol of 3 to 6 carbon atoms and 2 to 6 hydroxyls, e.g., ethylene glycol, glycerol, pentaerythritol, propylene glycol; salt, e.g., sodium chloride, potassium chloride, sodium sulfate, potassium iodide; and water. Yet, sorbitol and mannitol are useful components, as are other polyhydric alcohol plasticizer materials within the descriptions given. Most preferred of the polyols is glycerol and it is generally preferred that it be used in conjunction with sodium chloride and water, especially for the treatment of membranes intended for use in the electrolysis of brine. In such mixtures the glycerol content is usually 15 to 50%, preferably 20 to 45% and most preferably about 25 to 40%, the sodium chloride content is 15 to 35%, preferably 20 to 30% and most preferably about 25% and the water content is 15 to 70%, preferably 25 to 60% and most preferably about 35 to 50%.

The pH of the expansion solution may be any suitable pH over a wide range and will normally be in the range of 2 to 12, preferably 3 to 11. Acidic pH's employed are preferably 2 to 5 and most preferably 3 to 4, whereas basic pH's will usually be from 9 to 12, preferably 10 to 11. Neutral pH solutions are also operative.

The present invention is important because it gives the assembler of commercial membrane cells time in which to put the cells together without undue haste and without the risk of ruining the membrane, due to undesired changes of dimensions therein during the assembly. Furthermore, the process allows for controlled expansion or contraction of the cell membranes to desirably tighten or loosen them and maintain them flat and non-sagging in operation in the cell. No longer it will be found that after complete assembly of a cell bank some of the cells have had ruptured membranes, causing them to be inactive. The concept of preparing an expansion solution that allows for predictable stabilization of dimensions or changes thereof, as desired, which is a part of the present invention, has contributed significantly to commercial membrane cell manufacturing.

The following examples illustrate but do not limit the invention. Unless otherwise mentioned, all parts are by weight and all temperatures are in °C.

EXAMPLE 1

The following solvents, solutions or solvent systems are prepared and are used as soak media for a 0.2 mm. thick Nafion XR Dupont cation-active permselective membrane which is a hydrolyzed copolymer of tetrafluoroethylene and PSEPVE, wherein the PSEPVE content of the polymer is about 17% and the equivalent weight is about 1,300. The polymer is backed with a polytetrafluoroethylene cloth to which it is fused. The thickness of the filaments of the cloth is about 0.2 mm. and the percentage of open space between the filaments is about 20–25%. Following are the formulations of the soaking media:

| | |
|---|---|
| A | water |
| B | 25% aqueous sodium chloride solution |
| C | 40% glycerol, 25% sodium chloride, 35% water, pH 3.5 |
| D | 25% glycerol, 25% sodium chloride, 50% water, pH 3.5 |
| E | 30% glycerol, 25% sodium chloride, 45% water, pH 3.5 |
| F | 25% glycerol, 25% sodium chloride, 50% water, pH 10.5. |

Separate samples of the membrane, approximately 15 mm. on a side, are soaked in a different solvent media for thirty minutes each, after which they are removed and hung from supporting clamps, which allow any excess liquid to drain off. Periodically, at least every hour for the first five hours and every day until three days have gone by, they are measured and the percent expansion (linear) is noted. Expansion appears to be about the same lengthwise as across the widths of the specimens. The expansions are plotted as a graph of percent expansion vs. time and result in the graph of FIG. 2, wherein the curves correspond to the expansion solution media as follows: 11-A; 13-B; 15-C; 17-D; 19-E; and 21-F. It is noted that utilizing the expansion solution media which include polyhydric alcohol, sodium chloride and water, substantially constant expansions are obtained whereas with brine or water alone rather drastic significant dimensional changes result with the passage of time after completion of the soak operation.

In variations of this experiment similar results are obtained when, instead of soaking the membrane in the various media the media are applied to the membrane with a paint brush, roller or spray gun. In such cases the soak period may be shortened to ten minutes and even five minutes in some instances whereas even soaking periods as long as five hours are acceptable to yield essentially the same curves. In a further variation of the experiment the expansion solutions are applied to one side only of the membrane and the result is that the membrane expands unequally and curls with the side to which the expansion solution had been applied being on the outside. This technique can be used to shape membranes into curved positions, if desired. Also, when different solvent systems are applied to different sides of the membranes unequal expansions are produced but, especially when the media applied are glycerol-sodium chloride-water systems the difference in expansions is comparatively slight.

When instead of the systems described above other treating agents are employed, e.g., detergent solutions (sodium linear higher alkyl benzene sulfonates or polyethoxy higher alkanols); soaps (sodium coco-tallow); glycerol in water (25% glycerol - 75% water; 50% glycerol - 50% water; 75% glycerol - 25% water); lower alkanols (ethanol); propylene glycol-salt-water solutions, water-sorbitol solutions and other such mixtures, changes in the expansions of the membrane are noted and it is seen that several of these within the description of such systems herein given are of substantially flat expansion vs. time curves.

When, in view of the data reported in Example 1, similar experiments are run wherein a laminated membrane of the same type, except for one lamina being of an equivalent weight of about 1,100 and 0.1 mm. thick whereas the other is of an equivalent weight of 1,450 and is 0.05 mm. thick, is treated with a series of the C, D, E and F expansion solutions, essentially the same types of expansions are obtained.

EXAMPLE 2

Homogeneous and laminated membranes of Example 1 are treated in the manner described, for a one-half hour soaking period, after which they are each wiped dry, mounted on polypropylene cell frames by screwing into place with plastic or titanium screws, and allowed to stand for the same periods of time as described in Example 1, with expansions being measured (by measuring tautnesses of the membranes). It is found that the same types of expansions result and such results are also obtained when the other expansion solutions of Example 1 are utilized. In none of the cases with the polyol-salt-water mixtures is any membrane stretched so as to be torn during the period when its frame is awaiting assembly into a cell bank, which wait takes about four hours, at the longest. However, when instead of using the mentioned expansion solution, water is employed as the soaking medium, and in some cases when brine is employed, the membrane becomes overtight and is damaged while awaiting assembly into the cell bank.

After assembly of a fifty unit cell, which assembly takes four hours, the cell is filled with electrolyte (25% sodium chloride as the anolyte and water as the catholyte, with a small quantity of sodium hydroxide in the catholyte to help improve initial conductivity). The slight expansions noted when the acid brine media are employed and the slight contraction when the basic brine medium is used are unobjectionable and the membranes remain satisfactorily tight, flat and non-sagging in use and the cells operate efficiently. Operating conditions are:

Cell type: Two compartment, one membrane cell
Anode: ruthenium oxide coated expanded titanium mesh
Cathode: soft steel screen
Membrane: described above (two types)
Voltage: 4.0
Current density: 0.3 ampere/sq. cm.
Temperature: 88° C.
Products: 150 g./l. aqueous sodium hydroxide, chlorine and hydrogen The method described is also applicable to use with other membranes, such as anion-active permselective membranes and the RAI membranes described in the foregoing specification. However, best results appear to be obtained with the hydrolyzed copolymers of a perfluorinated hydrocarbon and a fluorosulfonated perfluorovinyl ether, such as previously described in this example.

When propylene glycol is substituted for the glycerol comparable results are obtained and when the proportions of the constituents are varied within the 15 to 50% glycerol, 15 to 35% sodium chloride and 15 to 70% water range similar useful effects also result.

The times after cessation of the soaking period are changed, as are the soaking periods, and the process is still usefully operative when the cell is not activated for from 4 to 24 hours and even 3 to 168 hours after completion of the immersion and when the immersion periods are from 5 minutes to 5 hours. Similarly, when treatment of the membrane is effected by coating by spraying, brushing, or rolling the medium onto the membrane essentially the same type of results is obtained. In some cases, when it is not feasible to start up electrolysis immediately, the cells are filled with electrolyte after assembly thereof and this also has the desirable effect of replacing the treating medium in the membrane and making it ready for cell startup without the danger of undesired expansion or contraction during the waiting period.

EXAMPLE 3

After continued operation for six months the cells of Example 2 are torn down and the membranes, held in place in individual cells, are readied for reuse by being sprayed with the treating media mentioned. They are then stored for periods of time of up to about three days before reinstallation in another cell and no objectionable drying out, tightening or tearing of the membrane due to contraction results. When such treatment of the membrane is not effected and it is allowed to stand in ambient air for as many hours objectionable tightening of the membrane results and in some cases the membranes are damaged, if not while standing still, when subjected to contact with other objects during handling, moving or installation.

EXAMPLE 4

The experiment of Example 2 is repeated with the membrane being coated on the side which is to face the anode with acid brine D and on the side which is to face the cathode with basic brine F, by spraying the treating solutions onto the surfaces of the membrane while it is hanging vertically. The spraying operations are continued for five minutes so that the surfaces can sufficiently soak up the media, after which the membranes are installed in cell frames. Twelve hours later the cells are filled with electrolyte and electrolysis is commenced. The membranes are not damaged due to excessive contractions (or expansions) before or during use and are maintained in a flat, non-sagging relationship with the electrodes of the cells.

In the above examples two compartment electrolytic cells are described but three compartment cells may be substituted for them with similar effects. In some cases polyol — water solvent media are employed instead, e.g., 50% glycerol, 50% water, and occasionally only the polyol will be utilized, with satisfactory results but it is highly preferred to employ the three component media previously described for best constant expansion vs. time curves, which lead to most predictable results.

The invention has been described with respect to specific examples thereof but is not to be limited to these because it is evident that one of skill in the art with the present specification before him will be able to utilize substitutes and equivalents without departing from the spirit of the invention or its scope.

What is claimed is:

1. A method of conditioning a cation-active permselective membrane which is a hydrolyzed copolymer of a perfluorinated hydrocarbon and a fluorosulfonated perfluorovinyl ether, for a subsequent use in an electrolytic cell, which method comprises expanding the membrane to a desirable extent by immersing the membrane in or coating the membrane with a liquid expansion solution comprising an aqueous solution wherein the solute of said solution is selected from the group consisting of sodium chloride, ethylene glycol, glycerine, sodium hydroxide, synethetic organic detergents, lower alkanols, higher fatty alcohols, organic acids, nineral acids, sequestrants, organic solvent materials, sorbitol, mannitol, polyhydric alcohols, pentaerythritol, and mixtures thereof in which method the membrane exhibits a substantially flat expansion vs. time curve for at least the first four hours in the air after completion of immersion or coating, mounting the membrane in an electrolytic cell, an electrolytic cell frame, or other cell mounting part, and contacting the membrane in the electrolytic cell with an electrolyte which has such expansion or contraction time characteristics as to produce or maintain a desired amount of tension on the membrane.

2. A method according to claim 1 wherein the permselective membrane is a cation-active permselective membrane which is a hydrolyzed copolymer of a perfluoronated hydrocarbon and a fluorosulfonated perfluorovinyl ether, and the liquid expansion solution comprises a polyol of 3 to 6 carbon atoms and 2 to 6 hydroxyls.

3. A method according claim 2 wherein the permselective membrane is a hydrolyzed copolymer of a perfluorinated hydrocarbon of 2 to 5 carbon atoms and a fluorosulfonated perfluorovinyl ether of the formula $FSO_2CF_2CF_2OCF(CF_3)CF_2OCF{=}CF_2$, and the liquid expansion solution is an aqueous one.

4. A method according to claim 3 wherein the perfluorinated hydrocarbon is tetrafluoroethylene, the content of perfluoro[2-(2-fluorosulfonylethoxy)-propyl vinyl ether] in the membrane polymer is about 10 to 30% and the equivalent weight is about 900 to 1,600, and the expansion solution is a mixture of glycerol, salt and water.

5. A method according to claim 4 wherein the PSEPVE content of the polymer of the permselective membrane is 15 to 20%, the membrane is from 0.1 to 0.5 mm. thick and the liquid expansion solution is an aqueous glycerine solution of sodium chloride wherein the glycerine content is 15 to 50%, the sodium chloride content is 15 to 35% and the water content is 15 to 70%.

6. A method according to claim 5 wherein the PSEPVE content of the permselective membrane is about 17%, the membrane is a laminated membrane having two laminae, one of which is about 0.07 to 0.17 mm. thick and of an equivalent weight of 1,000 to 1,200 and the other of which is from 0.01 to 0.07 mm. and of an equivalent weight of 1,350 to 1,600, the membrane is backed with a polytetrafluoroethylene network, screen or cloth to which it is fused and the expansion solution comprises 20 to 45% of glycerine, 20 to 30% of sodium chloride and 25 to 60% of water.

7. A method according to claim 6 wherein the expansion solution is of a pH of 2 to 4.

8. A method according to claim 1 wherein expansion of the membrane is effected by immersing in the expansion solution for a period from 5 minutes to five hours and the membrane is installed in an electrolytic cell and is put into use within a period of three hours to one week after the completion of the immersion in the expansion solution.

9. A method according to claim 8 wherein the immersion takes from ten minutes to one hour and the membrane is installed in an electrolytic cell for the electrolysis of brine and is put into use within a period of 4 to 24 hours after completion of immersion.

10. A method according to claim 7 wherein expansion of the membrane is effected by immersing in the expansion solution for a period of ten minutes to one hour and the membrane is installed in an electrolytic cell and is put into use within a period of 4 to 24 hours after the completion of immersion in the expansion solution.

* * * * *

UNITED STATES PATENT OFFICE

CERTIFICATE OF CORRECTION

PATENT NO. : 4,000,057

DATED : December 28, 1976

INVENTOR(S) : Kenneth S. Mrazek et al

It is certified that error appears in the above-identified patent and that said Letters Patent are hereby corrected as shown below:

Column 4, Line 18 "of" should appear as --or--.

Line 46 "15 mm." should appear as --15 cm.--.

Column 13, Line 34 "nineral" should appear as --mineral--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*